US005524839A

United States Patent [19]

Schade et al.

[11] Patent Number: 5,524,839

[45] Date of Patent: Jun. 11, 1996

[54] IMPACT ROLL CRUSHER ASSEMBLY

[75] Inventors: Jorge Schade, Castrop-Rauxel; Peter Stephan, Oer-Erkenschwick; Klaus Schaffer, Marl, all of Germany

[73] Assignee: Westfalia Becorit Industrietechnik GmbH, Germany

[21] Appl. No.: 281,451

[22] Filed: Jul. 27, 1994

[30] Foreign Application Priority Data

Aug. 5, 1993 [DE] Germany ..... 43 26 230.9

[51] Int. Cl.[6] ..... B02C 13/28; B02C 13/282; B02C 13/286

[52] U.S. Cl. ..... 241/101.2; 241/186.35; 241/187; 241/189.1; 241/191; 241/195; 241/294; 241/285.1; 241/300

[58] Field of Search ..... 241/101.2, 186.35, 241/187, 189.1, 191, 195, 294, 285.1, 285.2, 300

[56] References Cited

U.S. PATENT DOCUMENTS

| | | | |
|---|---|---|---|
| 399,025 | 3/1889 | Evans | 241/186.35 |
| 3,096,035 | 7/1963 | Allen et al. | 241/195 X |
| 3,126,014 | 3/1964 | Bonner, Jr. et al. | 241/187 X |
| 3,608,840 | 9/1971 | Lange | 241/187 X |
| 4,061,398 | 12/1977 | Parkes | 241/186.35 X |
| 4,077,575 | 3/1978 | Tillmanns | 241/300 X |
| 4,162,770 | 7/1979 | Lewis | 241/191 |

FOREIGN PATENT DOCUMENTS

| | | | |
|---|---|---|---|
| 0070547 | 7/1982 | European Pat. Off. . | |
| 2555638 | 6/1977 | Germany | 241/186.35 |
| 2917067 | 11/1980 | Germany | 241/186.35 |
| 178220 | 1/1966 | U.S.S.R. | 241/186.35 |
| 898845 | 6/1962 | United Kingdom | 241/186.35 |
| 2035841 | 6/1980 | United Kingdom | 241/186.35 |
| 2041240 | 9/1980 | United Kingdom | 241/186.35 |

*Primary Examiner*—Timothy V. Eley
*Attorney, Agent, or Firm*—Samuels, Gauthier, Stevens & Reppert

[57] ABSTRACT

An impact roll crusher for grinding up material, for example in mineral mining, employs a roll equipped with impact heads which co-operates with part of a conveyor transporting the material. The roll is rotatably mounted in a housing and a hood is connected to the housing to deflect and discharge the crushed material. The crusher roll is driven by a belt coupled to pulleys on the roll and on a drive motor shaft. The drive motor is supported by a bracket pivotably mounted on an inclined baffle wall of the hood. The roll drive adopts a position below the upper surface of the crusher housing. A tensioning device operable to adjust the tension in the drive belt is coupled to the bracket and adjusts the pivotable movement of the bracket.

17 Claims, 7 Drawing Sheets

FIG.5
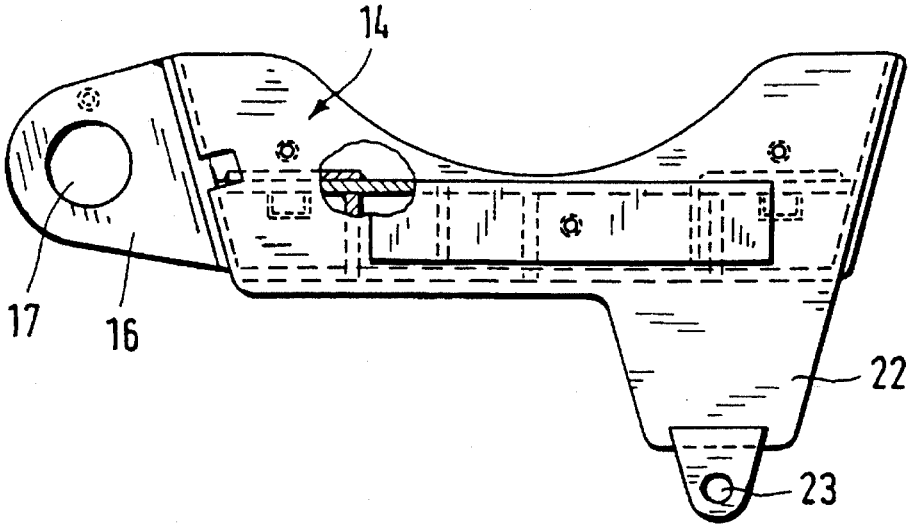
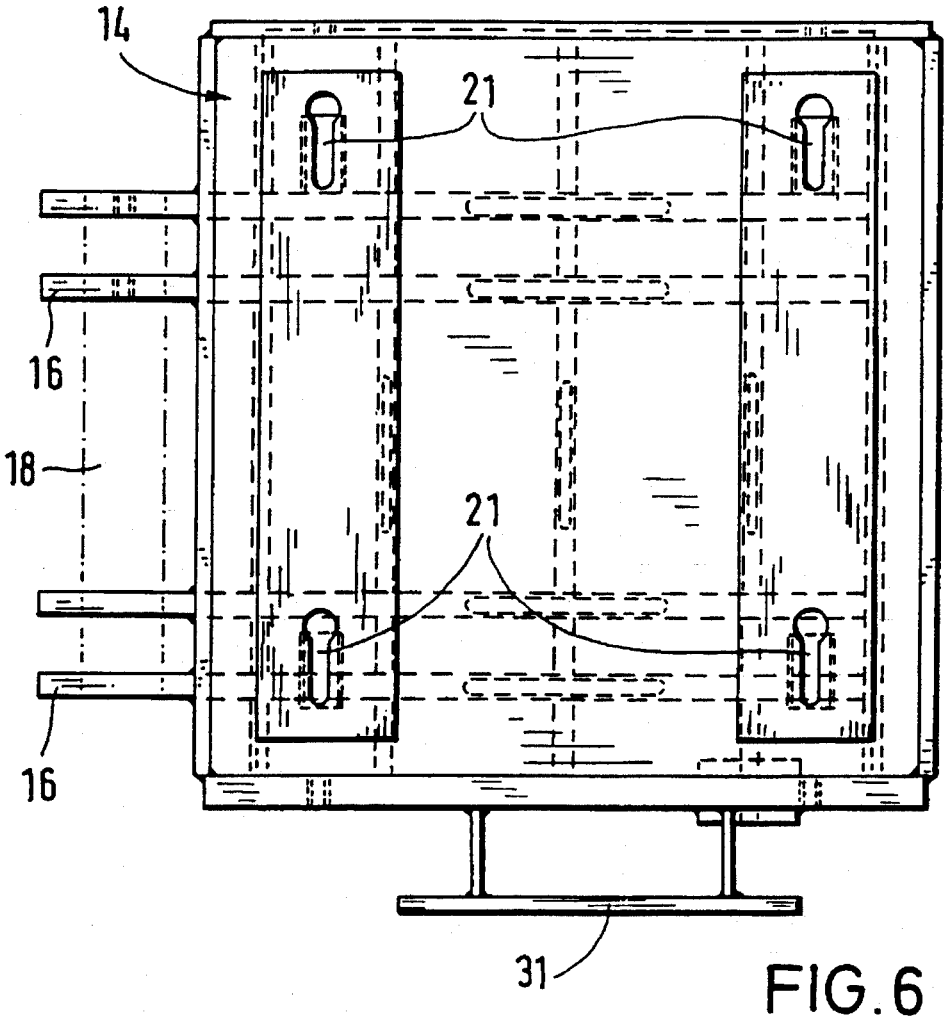
FIG.6

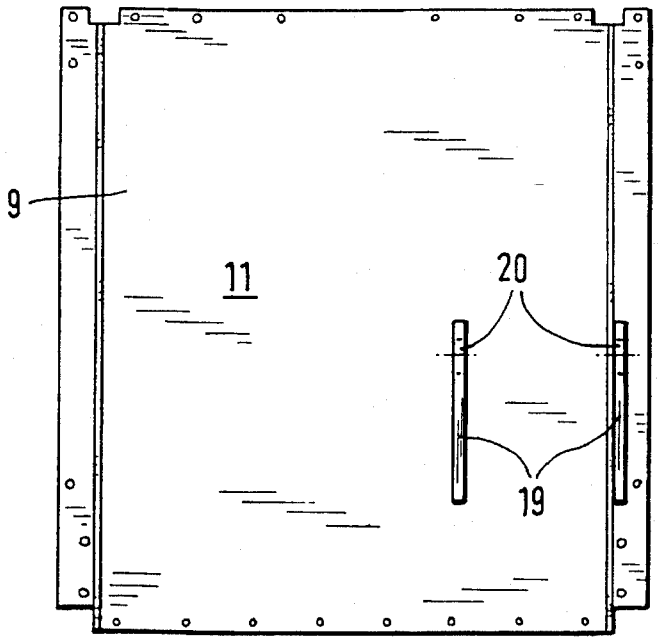
FIG.7
FIG.8
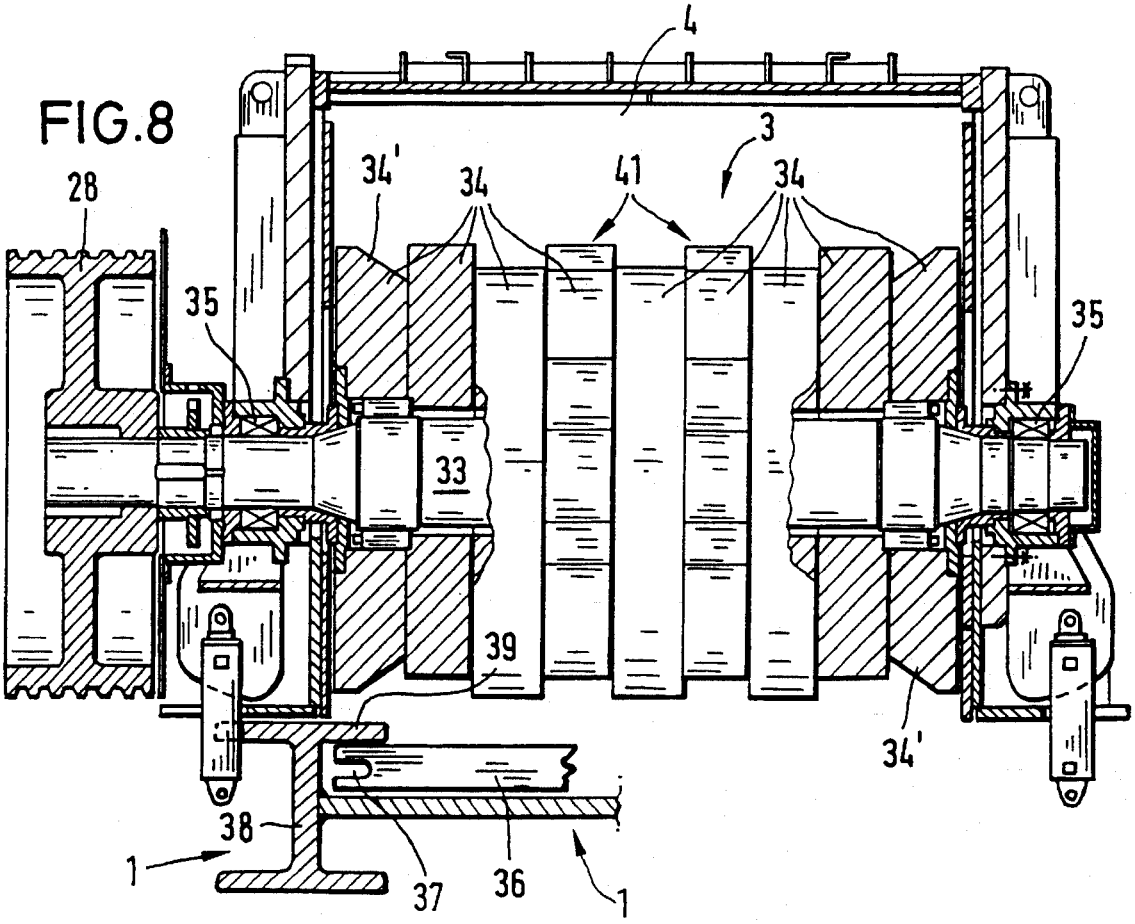

IMPACT ROLL CRUSHER ASSEMBLY

FIELD OF THE INVENTION

The present invention relates to an impact roll crusher and, more particularly, to an assembly employing such a crusher.

BACKGROUND TO THE INVENTION

Impact roller crushers are designed to reduce coarse material in mineral mining or quarrying to a smaller size. Usually such crushers have a rotating roll in a housing which co-operates with an end region of a conveyor to treat the material. The material is continuously passed between the roll and an abutment forming part of the conveyor and the material is broken down into smaller size grains or particles or lumps and discharged.

In one known design, the crusher roll drive takes up considerable space and especially in the vertical sense and this is a great disadvantage in cramped underground mine workings. Moreover, the crusher drive is not readily accessible or easily adjusted.

A general object of the present invention is to provide an impact roll crusher assembly of improved design.

SUMMARY OF THE INVENTION

According to the present invention there is provided an impact roll crusher assembly comprising an impact roll crusher composed of a housing and an impact roll supported for rotation in the housing;

at least part of a conveyor for transporting material to be treated which co-operates with the impact roll, the impact roll being rotatable about an axis which extends transversely of the direction in which the material is transported by the conveyor;

a crusher drive composed of a motor, an elongate drive member for drivably coupling the roll to the motor for rotatably driving the roll, the crusher drive motor and drive member being located externally of the crusher housing and a discharge hood fitted to the crusher housing and having a discharge opening for discharging material after crushing, wherein the discharge hood has an inclined wall which serves to deflect and guide material from the crusher housing to the discharge opening and the crusher drive motor is mounted on the inclined wall of the hood below an uppermost surface of the crusher housing.

The conveyor part and the crusher and its mounted drive can be carried by a common frame resting on the floor of the working and this frame can conveniently also support drive means for driving the conveyor. The arrangement according to the invention ensures the overall height of the assembly is defined solely by the height of the crusher housing and this permits use of the assembly even in cramped mine workings.

Preferably, the crusher drive motor is mounted on a support bracket which is adjustable or displaceable relative to the inclined wall of the discharge hood to control the tension in the drive member which can be an endless belt. The bracket can be pivotably mounted to the inclined wall with a pivot joint having an axis generally parallel to the crusher roll axis and the pivot joint is disposed below the crusher drive motor. To control the tension in the drive member a tensioning device, such as a screw threaded spindle, can be coupled between a side of the hood and the motor support bracket.

The drive member can be entrained around pulleys respectively connected to an output shaft of the crusher motor and to the crusher roll. The drive member or belt can adopt a position at a slight angle to the horizontal and this is particularly advantageous.

A protective cover can extend around the pulleys and the drive member. The tensioning device then has an upper end region extending between the cover and the drive member and the side of the hood and connected with a pivot joint to the bracket.

The provision of the tensioning device easily accessible for adjustment of the tension in the drive member and the general arrangement of the crusher drive in accordance with the invention is particularly advantageous. The crusher roll housing is not directly exposed to the weight of the crusher drive motor and instead the inclined hood wall is used to support the motor. This wall, which acts as a deflecting baffle for the material discharged from the crusher housing, must be strong in any event to perform its main function. The inclined wall is preferably reinforced in any event with wear resistant plates on its inner surface. The weight of the crusher drive motor is converted into compressive force acting through the discharge hood on the end of the crusher housing.

The conveyor may be a scraper-chain conveyor and in this case the part associated with the crusher may have I-shaped side walls with a floor plate therebetween for guiding the scrapers, the side walls having upper flanges which confront the impact roll and act as an abutment for the crushing of material.

The impact roll itself can be composed of a series or stack of discs carrying impact tools or heads arranged side-by-side on a spindle rotatably supported by bearings in or on the crusher housing. The spindle can be adjustable in position to vary the crushing action and the size of the particles, grains or lumps discharged. The discs can have recesses for receiving the impact heads and locking bolts serve to secure the impact heads within the recesses. Each of the recesses can have a radial support face engaging with a rear face of a support portion of the associated impact head and the mounted locking bolt then extends through a bore in the disc perpendicular to the rear face and passes through an open slot in the support portion of the head. This permits the locking bolt to be loosened and the head withdrawn without removal of the bolt. Preferably, the support portion of the head engages in a hook-like fitting action with a projection in a depression in a wall of the recess opposite the radial support face. The impact head can have a front face opposite the rear face which is inclined relative to the rear face and merges over a curved region with a shoulder of the projection extending parallel to the longitudinal axis of the locking bolt, The associated locking bolt can then have a clamping member shaped to engage and clamp against part of the front face and on the shoulder and curved region.

The invention may be understood more readily, and various other aspects and features of the invention may become apparent, from consideration of the following description.

BRIEF DESCRIPTION OF THE DRAWINGS

An embodiment of the invention will now be described, by way of example only, with reference to the accompanying drawings, wherein:

FIG. 5 is a part-sectional side view of a motor support bracket used in the assembly depicted in FIGS. 1 to 4;

FIG. 6 is a plan view of the bracket shown in FIG. 5;

FIG. 7 is a view of a discharge hood taken in the direction of arrow VII in FIG. 3 with the crusher drive and motor support bracket removed;

FIG. 8 is a vertical section through the impact roll crusher of the assembly;

DESCRIPTION OF PREFERRED EMBODIMENTS

Figure 1:
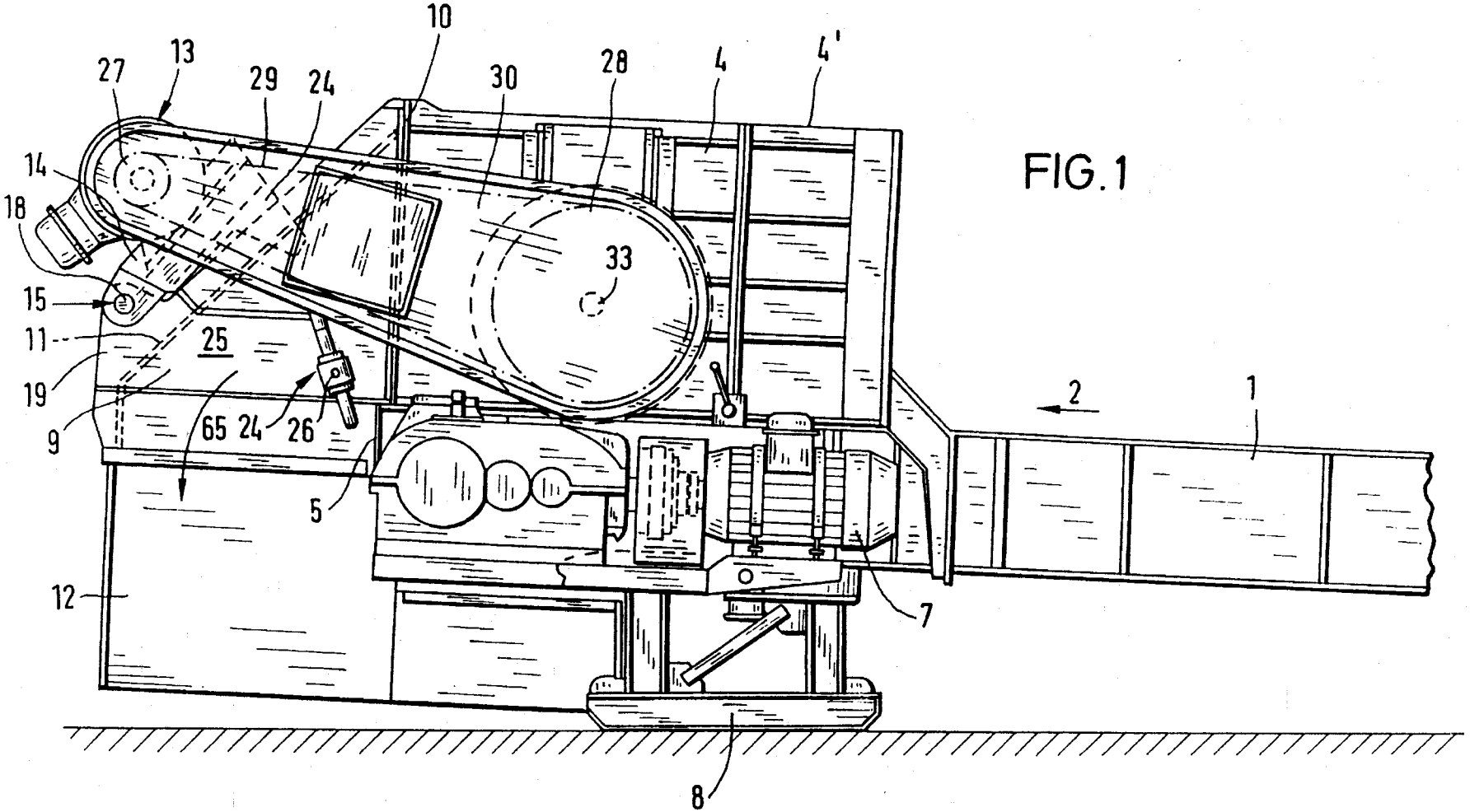
FIG. 1 is a side view of an assembly constructed in accordance with the invention and composed of a discharge end region of a conveyor, an impact roll crusher and drives for the conveyor and crusher.
Figure 2:
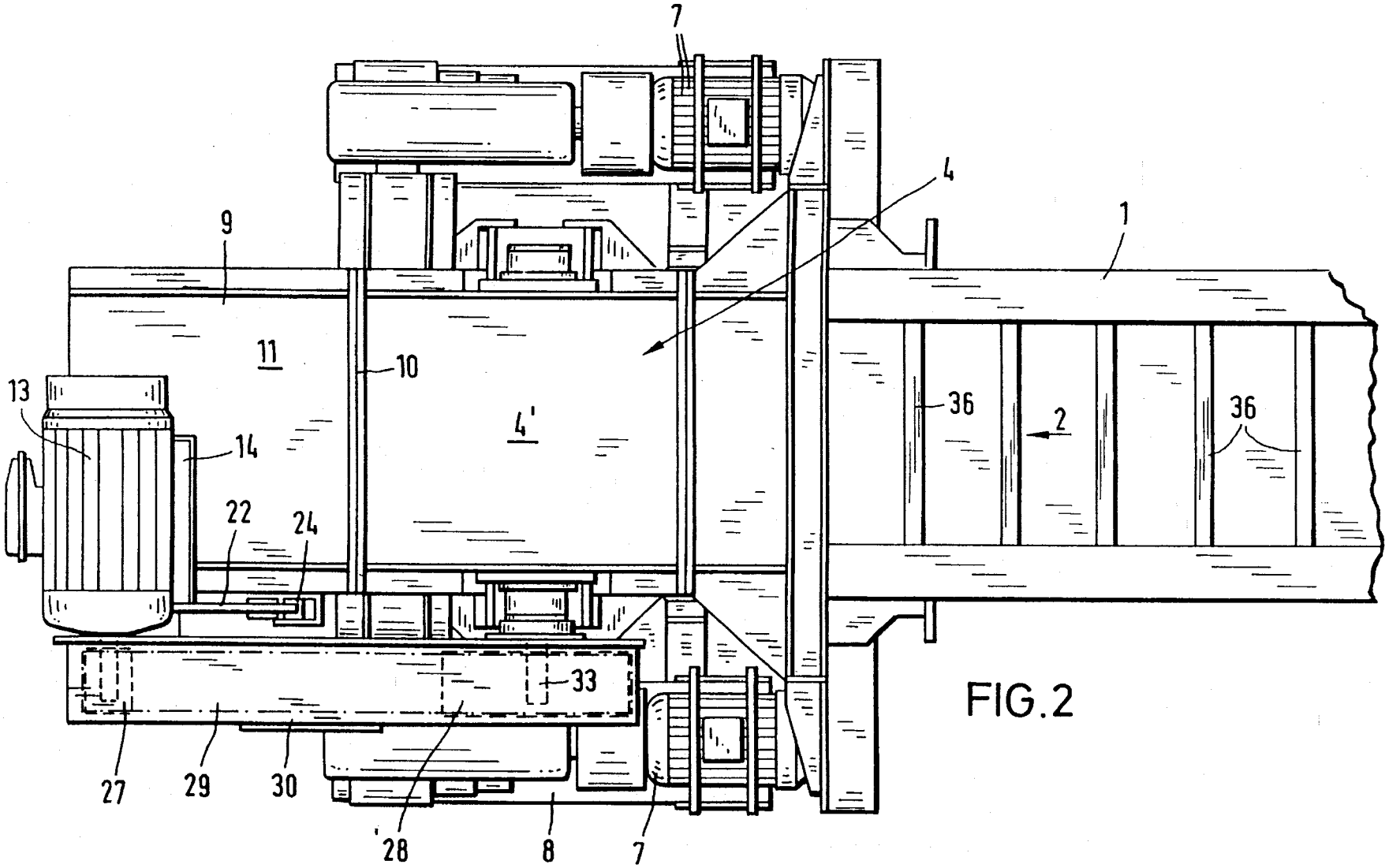
FIG. 2 is a plan view of the assembly shown in FIG. 1.
Figure 3:
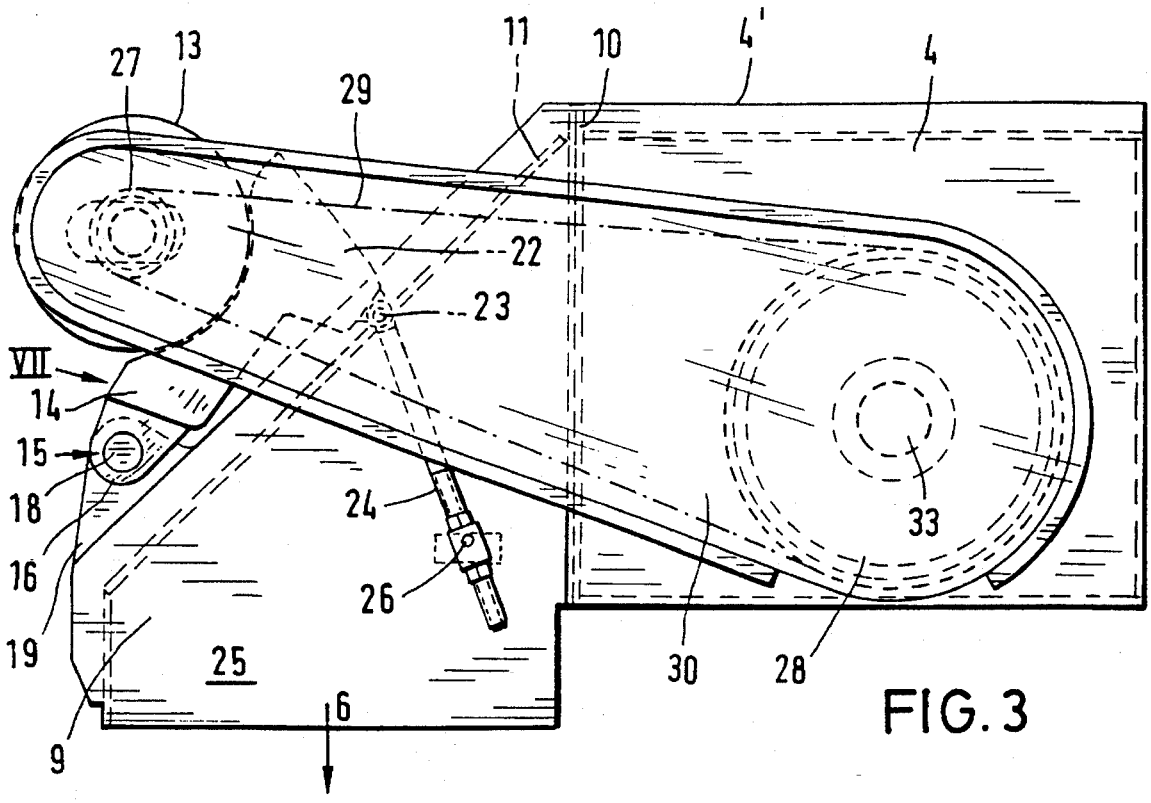
FIG. 3 is a simplified schematic side view representation of part of the assembly taken on a somewhat larger scale to FIG. 1.
Figure 4:
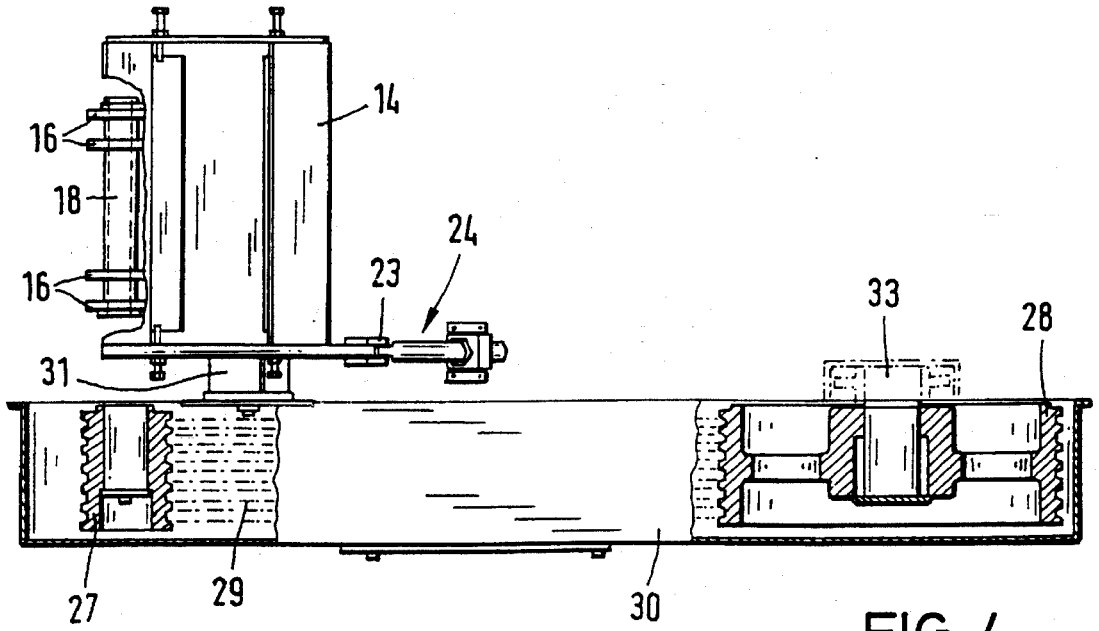
FIG. 4 is a part-sectional plan view of some components of the part assembly represented in FIG. 3.

In general, and as depicted in FIG. 1, an impact roll crusher 65 serves to operate continuously to crush material transferred along a conveyor 1. Material can be delivered onto the conveyor 1 at any region along its length and the material is transported by the conveyor 1 in the direction of arrow 2 to the crusher. The crusher employs a driven impact roll 3 (FIG. 8) which rotates about a horizontal axis extending transversely to the conveying direction 2 above an end region of the conveyor 1 in a housing 4. The roll 3 crushes the material between the roll 3 and part of the conveyor 1 acting as an abutment. The housing 4 defines a discharge opening 5 from whence the now crushed loose material is deflected and discharged downwardly in the direction of arrow 6. The impact roll crusher is united in an assembly which also employs a conveyor drive means composed of motors 7 on opposite sides of the conveyor. The conveyor 1 with its drive means 7 and the crusher with its drive are supported by a common frame with a base 8 resting on the floor of a mine or drift working. The opening 5 of the crusher housing 4 is covered by a discharge hood 9 detachably fitted to the housing 4. Conveniently, the hood 9 is fitted to the housing 4 with screws engaged in bores in inter-engaging flanges as indicated by reference numerals 10 in FIG. 1. The hood 9 has an inclined wall 11 extending over the discharge zone of the hood 9 to act as a deflecting baffle for material thrown out from the impact roll 3. A further deflecting member or chute 12 can be located beneath the hood 9 to receive the material deflected from the wall 11 and guides the material for the downward discharge 6. The wall 11 of the hood 9 is inclined at an angle of about 40° to 50° to the horizontal and the inner face of this wall 11 is preferably equipped with a number of replaceable wear resistant plates.

The crusher drive takes the form of a motor 13 mounted on the outer face of the wall 11 in a location below the upper surface 4' of the crusher housing 4. The crusher drive motor 13 is supported by a tiltable bracket 14 below the drive motor 13. The bracket 14 is pivotably carried on the wall 11 by means of a pivot joint 15 with a horizontal axis transverse to the conveying direction 2.

As shown in FIGS. 5 and 6, the bracket 14 has two fork-like connecting pieces 16 with eyes 17 for receiving a pivot pin 18 (FIG. 8) of the pivot joint 15. As shown in FIG. 7, the wall 11 of the hood 9 is likewise formed with connection pieces 19 with eyes 20 for receiving the pin 18. FIG. 6 shows that the bracket 14 also has keyhole-shaped slots 21 for receiving bolts for mounting the drive motor 13 and for permitting adjustment of the motor 13 relative to the bracket 14. The motor 13 drives the roll 3 of the crusher by way of a belt 29. As shown in FIGS. 1 to 5, the bracket 14 has a depending plate portion 22 with a lug in which there is an aperture 23 for facilitating the connection of a belt tensioning device 24. The plate portion 22 engages over a side face of the hood 9 as shown in dotted outline in FIG. 1. The tensioning device 24 can be connected to the bracket 14 with a pivot pin engaged in the aperture 23 and the device 24 can be operated to displace the bracket 14 about the pivot joint 15 in order to adjust the tension in the drive belt 29. The device 24 can be left connected to the bracket 14 and supported against a side wall 25 of the hood 9 with a connection 26. The drive belt 29 for rotating the impact roll 3 is entrained around a first smaller pulley 27 supported on the shaft of the drive motor 13 and a second larger pulley 28 supported on a spindle or shaft of the impact roll 3. The pulley 28 is disposed on the outside of the crusher housing 4. The drive belt 29, which can be a V-belt, drivably couples the roll 3 to the motor 13. The belt 29 and its pulleys 27, 28 are all disposed within a protected cover 30 which extends over the side walls of the housing 4 and the hood 9 as well as the bracket 14. As shown in FIG. 6, the bracket 14 has a flanged member 31 on which the cover 30 is detachably mounted. Conveniently the cover 30 is fixed with screws or bolts for easy release.

It can be seen from the drawings that not only the drive motor 13 but also the belt drive system 27, 28, 29 and the cover 30 all lie below the upper surface 4' of the crusher housing 4. The belt 29 extends in a vertical plane (FIG. 1) but at a small angle to the horizontal in relation to the housing 4 and the hood 9. FIGS. 1 to 4 also show that the tensioning device 24 is located below the belt 29 and extends with its upper portion behind the cover 30 i.e. between the cover and the side face 25 of the hood 9 to locate with the bracket 14. The device 24 can thus be operated to tension the belt 29 without dismantling the cover 30. The drive motors 7 for the conveyor 1 lie below the belt 29 and the housing 4.

As shown particularly in FIG. 8, the impact roll 3 which rotates in the housing 4 is composed of a plurality of stacked discs 34 fixed on a support spindle 33. All the discs 34 have the same diameter and the discs 34 are equipped with impact tools or heads 41 described hereinafter. The spindle 33 extends horizontally transverse to the conveying direction 2 and is supported for rotation in bearings 35 mounted at the sides of the housing 4. The drive pulley 28 is fixed on the outer end of the spindle 33 adjacent the belt 29 and outside the housing 4. The roll 3 is preferably adjustable in a vertical sense in the housing 4 in order to vary the size of the crushed material. This can be accomplished by mounting the bearings 35 on displaceable supports guided on the housing 4 and by providing hydraulic rams depicted in FIG. 8 to displace the bearing supports.

The conveyor 1 is preferably a scraper-chain conveyor with scrapers 36 spaced apart along one or more chains. The scrapers 36 are guided in guide channels 37 formed by the side walls 38 of individual channel sections or pans. At least in the region of the assembly and the crusher with its common frame the side walls 38 of the end most channel section have stout I-shaped profiles with a floor plate therebetween. The side walls 38 have their upper flanges 39 located immediately beneath the impact roll 3. This region of the conveyor 1 beneath the roll 3 acts as an abutment for the material crushed by the roll 3. The outermost disc 34 on the spindle 33 are bevelled as at 34' to prevent material accumulating and jamming between the roll 3 and the upper flanges 39.

Figure 9:
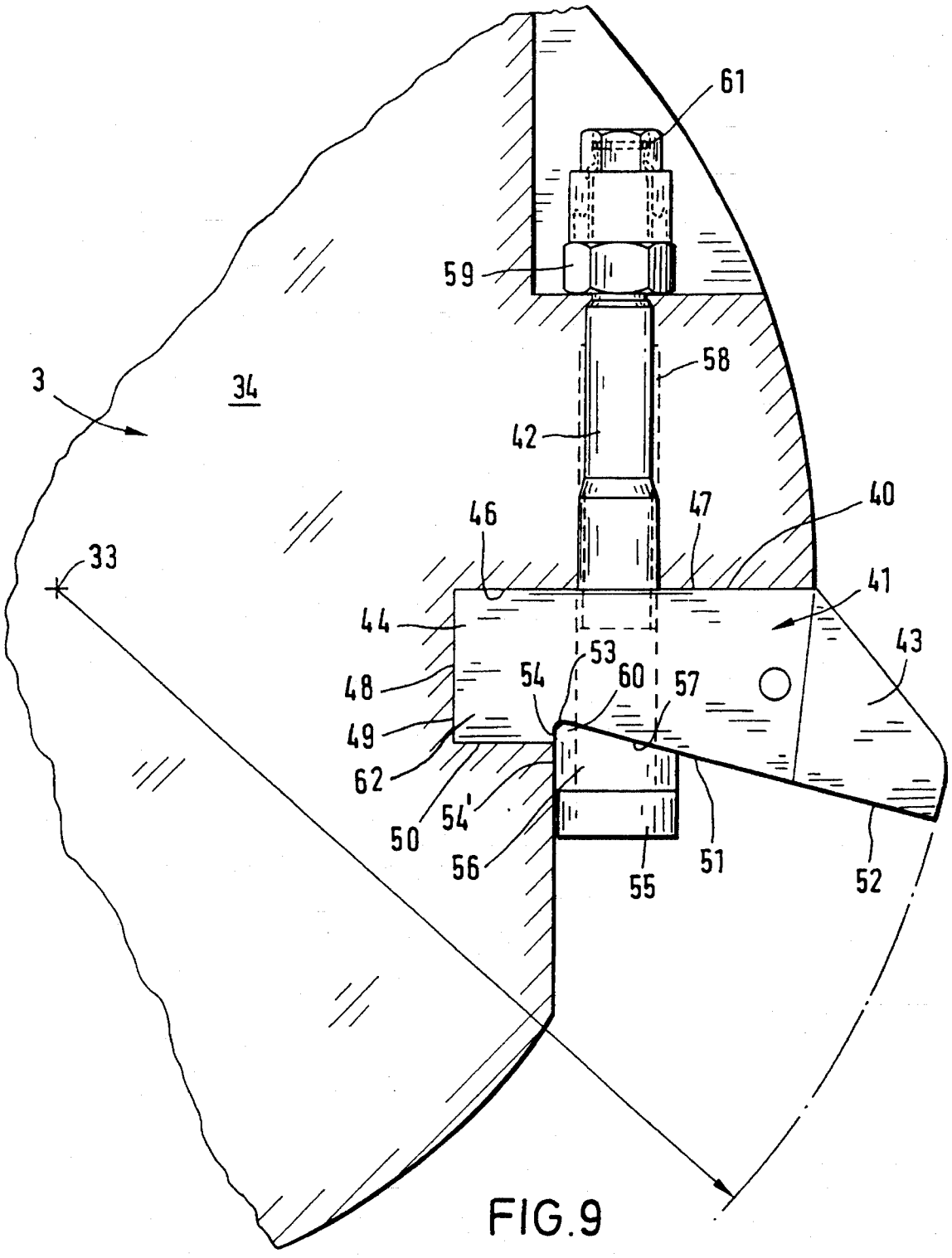
FIG. 9 is a partial cross-section taken normally to the axis of rotation of the impact roll and showing one of the impact heads.
Figure 10:
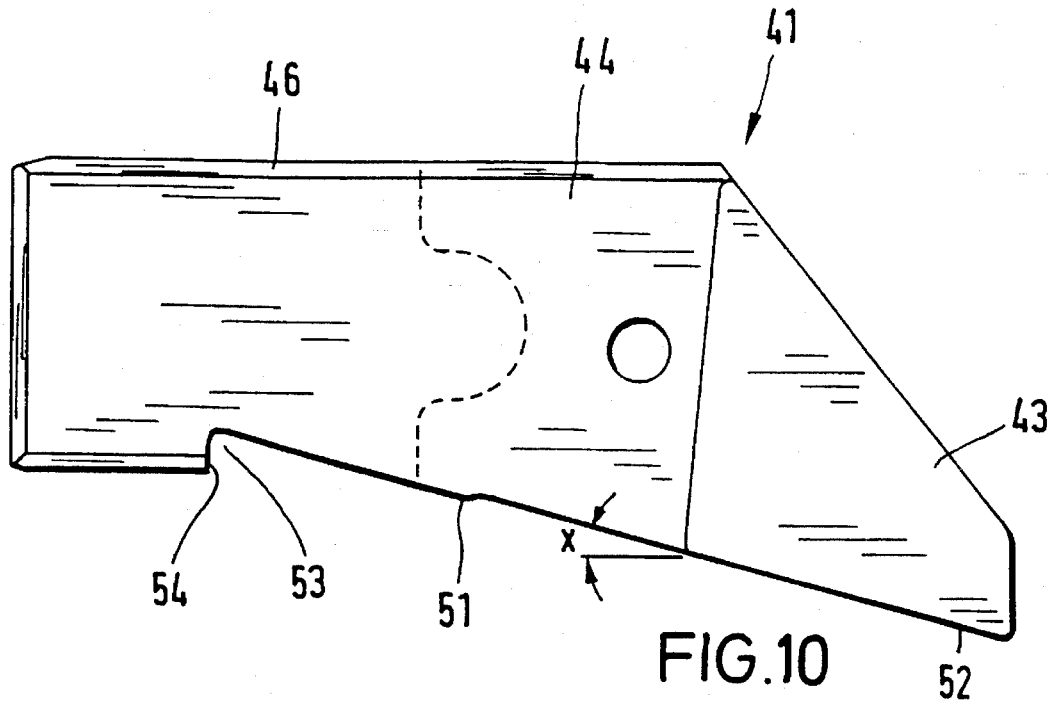
FIG. 10 is a side view of the impact head depicted in FIG. 9.
Figure 11:
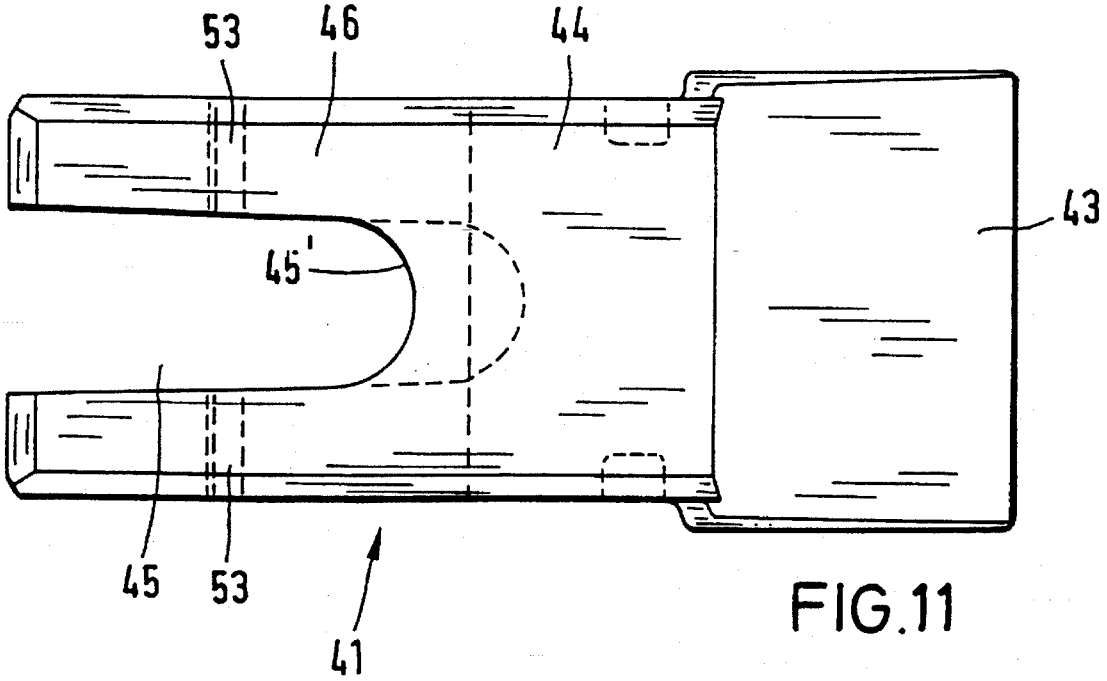
FIG. 11 is a plan view of the impact head shown in FIGS. 9 and 10.

FIGS. 9 to 11 depict one design for the impact heads 41 and their attachment to the discs 34. Each impact head 41 has a impact portion 43 projecting beyond the periphery of its associated disc 34 and a support portion 44. Each disc 34 has a recess 40 which receives the portion 44 of the associated impact head 41 which is secured in place with a locking bolt 42. The portion 44 engages in the recess 40 in shaped-locked fashion and is provided with a slot 45 open toward the free inner end of the head 41 and into which the bolt 42 is received. When assembled to the disc 34 the head 41 is supported with its rear flat face 46 on a support face 47 of the recess 40 extending radially of the disc 34. The recess 40 is shaped with an inner depression or groove 48 which receives a corresponding projection 62 of the portion 44 as shown in FIG. 9 to provide a hook-like shape-locking. The inner face 49 of the recess 40 which forms a continuation of the rear wall of the depression 48 extends perpendicularly to the support face 47 and perpendicularly to a bottom wall 50 of the depression 48. The free front face 51 of the head 41 opposite the rear face 46 extends at an angle X, preferably about 15°, to the rear face 46 and extends with a region 52 as a working face over the exposed impact portion 43. The projection of the support portion 44 which engages in the depression 48 merges smoothly with the front face 51 at a curved transition zone 53 and a shoulder 54 parallel to the inner face 49 and the axis of the locking bolt 42. The shoulder 54 forms a continuation of a surface 54' of the recess 40. The locking bolt 42 has an end piece 55 of square cross-section. An intermediate clamping member 56 fits snugly between the end piece 55 and the faces 51, 54, 54' as shown in FIG. 9. The member 56 can have a bore which receives the shank of the bolt 42 and the member 56 can be welded to the end piece 55. It is of course possible to unite the end-piece 55 with the intermediate member 56. The member 56 has a frusto-conical profile with a surface 57 designed to bear on the face 51 and a projection 60 designed to engage in the zone 53 and to bear on the faces 54, 54'. In this way, the impact head 41 is positively locked into the recess 40 as the bolt 42 is tightened and tensioned. During assembly of the impact head 41 to the disc 34, the bolt 42 is introduced into a bore 58 in the disc 34 and a nut 59 is screwed onto the free threaded end region of the bolt 42. With the nut 59 loosely coupled to the bolt 42 the impact head 41 is inserted into the recess 40 so the support portion 44 fits into the recess 40 and the depression 48 and the slot 45 engages around the shank of the bolt 42 and abuts the latter with a rounded face 45' (FIG. 11). The nut 59 is now tightened to force the clamping member 56 into locking engagement with the head 41. A lock nut 61 is used to secure the nut 59 when the head 41 has been set. When the impact head 41 is to be replaced the nut 59 need only be released to the extent necessary to enable the member 56 to be disengaged. The head 41 can then be withdrawn.

We claim:

1. An impact roll crusher assembly comprising:

an impact roll crusher composed of a housing, an impact roll and means for supporting the impact roll for rotation in the housing;

a conveyor wherein at least part of the conveyor for transporting material to be treated co-operates with the impact roll, the impact roll being supported for rotation about an axis which extends transversely of the direction in which the material is transported by the conveyor;

a crusher drive composed of a motor and an elongate drive member for drivably coupling the impact roll to the motor for rotatably driving the roll, the crusher drive motor and the drive member being located externally of the crusher housing; and a discharge hood fitted to the crusher housing and having a discharge opening for discharging material after crushing, wherein the discharge hood has an inclined wall having an inner surface, the inclined wall serves to deflect and guide material from the crusher housing to the discharge opening, the crusher drive motor is mounted on a support bracket which is pivotably mounted on the inclined wall of the hood below an uppermost surface of the crusher housing, and means is provided for adjusting the tension in the drive member by pivotal movement of the support bracket.

2. An assembly according to claim 1, wherein the drive member is an endless belt.

3. An assembly according to claim 1, wherein the crusher drive motor is mounted on a support bracket which is adjustably carried on the inclined wall of the hood to permit variation of tension in the drive member.

4. An assembly according to claim 1, wherein the bracket is pivotably mounted to the inclined wall with a pivot joint having an axis generally parallel to the crusher roll axis and the pivot joint is disposed below the crusher drive motor.

5. An assembly according to claim 4, wherein the pivot joint between the bracket and the inclined wall is formed by connection pieces on the bracket and the inclined wall, the connector pieces being provided with eyes and a pivot pin fitting through the eyes of the connection pieces.

6. An assembly according to claim 4, wherein the adjustment means is a tensioning device for displacing the bracket to vary the tension in the drive member, said tensioning device being mounted between a side connection of the hood and the bracket, the drive member is entrained around pulleys respectively connected to an output shaft of the crusher motor and to the crusher roll, a protective cover extends around the pulleys and the drive member and the tensioning device has an upper end region extending between the cover and the drive member and the side of the hood and is connected with a pivot joint to the bracket and wherein the pivot joint between the inclined wall and the bracket is disposed below the protective cover.

7. An assembly according to claim 6, wherein the protective cover is releasably connected to the bracket.

8. An assembly according to claim 1 wherein the adjustment means is a tensioning device for displacing the bracket to vary the tension in the drive member, said tensioning device being mounted between a side connection of the hood and the bracket.

9. An assembly according to claim 8, wherein the drive member is entrained around pulleys respectively connected to an output shaft of the crusher motor and to the crusher roll, a protective cover extends around the pulleys and the drive member and the tensioning device has an upper end region extending between the cover and the drive member and the side of the hood and is connected with a pivot joint to the bracket.

10. An assembly according to claim 1, wherein the inclined wall has on its inner surface a number of wear resistant plates.

11. An assembly according to claim 1, wherein the conveyor is a scraper-chain conveyor and said part of the conveyor has I-shaped side walls with a floor plate therebetween for guiding the scrapers, the side walls having upper flanges which confront the impact roll and form an abutment co-operating with the impact roll.

12. An assembly according to claim 11, wherein the impact roll is composed of a plurality of discs stacked side-by-side on a rotatable spindle and impact heads fitted to the discs.

13. An assembly according to claim 1, wherein the drive member extends in a generally horizontal disposition or at a slight angle to the horizontal.

14. An impact roll crusher assembly comprising:

an impact roll crusher composed of a housing, an impact roll and means for supporting the impact roll for rotation in the housing;

a conveyor wherein at least part of the conveyor for transporting material to be treated co-operates with the impact roll, the impact roll being supported for rotation about an axis which extends transversely of the direction in which the material is transported by the conveyor;

a crusher drive composed of a motor and an elongate drive member for drivably coupling the impact roll to the motor for rotatably driving the roll, the crusher drive motor and the drive member being located externally of the crusher housing; and a discharge hood fitted to the crusher housing and having a discharge opening for discharging material after crushing, the discharge hood has an inclined wall having an inner surface which serves to deflect and guide material from the crusher housing to the discharge opening and the crusher drive motor is mounted on the inclined wall of the hood below an uppermost surface of the crusher housing, wherein the impact roll is composed of a plurality of discs stacked side-by-side on a rotatable spindle and impact heads are fitted to the discs, the discs having recesses for receiving the impact heads and locking bolts serve to retain the heads within the recesses, each of the recesses having a radial support face engaging with a rear face of a support portion of the associated impact head and the associated locking bolt extends through a bore in the disc perpendicular to the rear face and passes through an open slot in the support portion of the head, the support portion of each impact head has a projection which fits into a depression in a wall of the recess opposite the radial support face, each impact head has a front face opposite the rear face which is inclined relative to the rear face and merges over a curved region with a shoulder of the projection extending parallel to the longitudinal axis of the locking bolt and wherein the associated locking bolt has a clamping member shaped to engage and clamp against part of the front face and on the shoulder and curved region.

15. An assembly according to claim 14, wherein part of the front face of each impact head projects outwardly from the associated disc for impact with the material being crushed.

16. An assembly according to claim 14, wherein the locking bolt clamping member is of polygonal shape.

17. An assembly according to claim 14, wherein the angle of inclination of the front face of each impact head is about 15°.

* * * * *

UNITED STATES PATENT AND TRADEMARK OFFICE

CERTIFICATE OF CORRECTION

PATENT NO. : 5,524,839

DATED : June 11, 1996

INVENTOR(S) : Jorge Schade et al.

It is certified that error appears in the above-indentified patent and that said Letters Patent is hereby corrected as shown below:

On the Title page, item [73], Assignee: should be Westfalia & Braun Zerkleinerungstechnik GmbH & Co.

Signed and Sealed this

Seventh Day of January, 1997

Bruce Lehman

*Attest:*

BRUCE LEHMAN

*Attesting Officer*

*Commissioner of Patents and Trademarks*